United States Patent [19]

Liljekvist et al.

[11] Patent Number: 4,598,779

[45] Date of Patent: Jul. 8, 1986

[54] ROCK DRILL BIT

[75] Inventors: Bernt S. Liljekvist, Storvik; Bo Carl G. Nordmark; Tommy S. Tukala, both of Sandviken, all of Sweden

[73] Assignee: Santrade Limited, Lucerne, Switzerland

[21] Appl. No.: 650,663

[22] Filed: Sep. 14, 1984

[30] Foreign Application Priority Data

Sep. 20, 1983 [SE] Sweden ..... 8305048

[51] Int. Cl.[4] ..... E21C 13/06

[52] U.S. Cl. ..... 175/410; 175/413; 175/415

[58] Field of Search ..... 175/410, 412, 413, 414, 175/415

[56] References Cited

U.S. PATENT DOCUMENTS

| | | | |
|---|---|---|---|
| 2,097,030 | 10/1937 | Killgore | 175/410 X |
| 2,689,109 | 9/1954 | Curtis | 255/64 |
| 2,879,973 | 3/1959 | Saxman | 175/410 X |
| 4,202,421 | 5/1980 | Pinck | 175/410 |
| 4,254,840 | 3/1981 | Shay, Jr. | 175/410 |

FOREIGN PATENT DOCUMENTS

| | | | |
|---|---|---|---|
| 2522300 | 12/1976 | Fed. Rep. of Germany . | |
| 2315602 | 6/1976 | France | 175/410 |

*Primary Examiner*—Stuart S. Levy
*Assistant Examiner*—David Werner
*Attorney, Agent, or Firm*—Burns, Doane, Swecker & Mathis

[57] ABSTRACT

A rock drill bit of the impact type comprising a boring head, a shaft having ridges, a front surface and a number of peripherally spaced holes receiving inserts, said holes extending forwardly and outwardly at an acute angle $\phi$ with respect to the center line of the drill bit. The guiding surface of the insert mainly coincides with the jacket surface of the bit body when the insert has been fixed in the hole which emerges into both the jacket surface and the front surface of the bit body. This means that the guiding surface partly extends on both sides of the plane of the front surface.

18 Claims, 8 Drawing Figures

ROCK DRILL BIT

BACKGROUND AND SUMMARY OF THE INVENTION

This invention concerns a rock drill bit with chisel-shaped inserts placed in gun-drilled holes of the rock drill bit. The center line of each insert when inserted into the hole inclines an angle $\phi$ relative to the center line of the rock drill bit and the guiding surface of each insert generally coinciding with the jacket surface of the bit body extends partly on both sides of the plane of front surface of the bit. The cutting edge of each insert is arranged axially outside said plane.

Hitherto known rock drill bits have inserts in holes that emerges only into the front surface and that in some cases inclines relative to the center line of the bit. Known inserts with a rectangular shape having a center line parallel with the center line of the bit has a disadvantage, common with the first-mentioned inserts, in that they tend to bore in an inclined manner. Rock drill bits having conventional inserts in the periphery cause an unstable drilling operation due to the shape of the inserts so that the bores get inclined in the longitudinal direction. Bits provided with rectangular inserts also cause inclined bores as the periphery of the bit only can receive a small number of inserts due to that the brazing process demands a lot of material around each insert and therefore a small number of guiding points are achieved. Only a few regrindings of the inserts may be done and yet obtaining a bore with an acceptable diameter.

The object of the present invention is to provide an improved rock drill bit that solves the above-mentioned problems.

BRIEF DESCRIPTION OF THE DRAWINGS

The invention will be described in the following in connection with the accompanying drawings wherein other characterizing features and advantages of the invention will appear.

DETAILED DESCRIPTION OF PREFERRED EMBODIMENTS OF THE INVENTION

Figure 1:
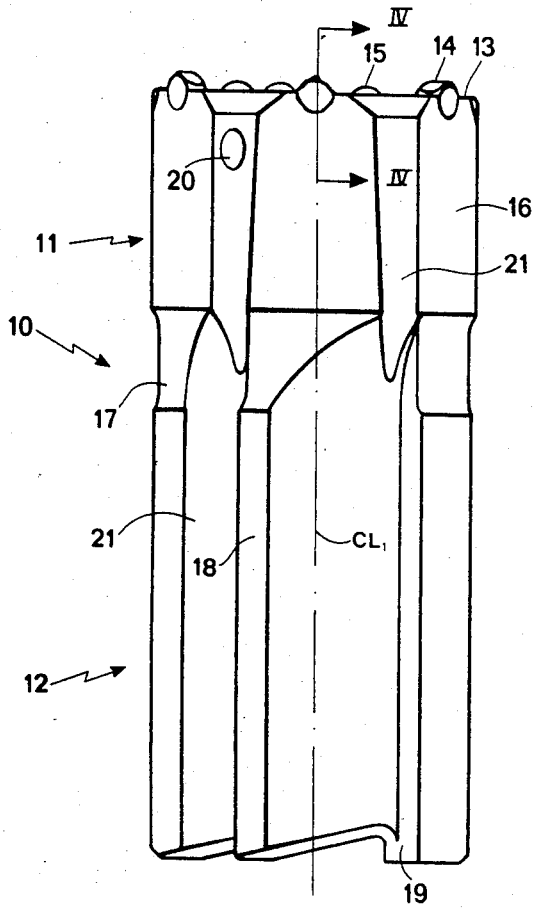
FIG. 1 shows a side view of a rock drill bit according to the present invention.
Figure 3:
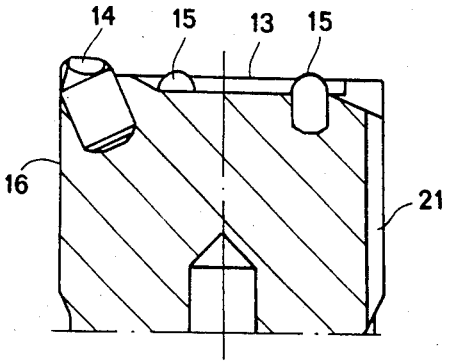
FIG. 3 shows a section of a part of the rock drill bit along the line III—III in FIG. 2.

In the embodiment shown in FIGS. 1 to 4 the improved rock drill bit of the impact type is generally designated 10 and has a boring head 11, a shaft 12, a front end including a front surface 13 provided with fixed chisel-shaped inserts 14 and front inserts 15. The jacket surface 16 of the rock drill bit 10 has a cylindrical form and is defined in FIG. 1 at the boring head. The jacket surface 16 may, however, be defined anywhere along a part of the bit in the longitudinal direction but preferably it is defined at the part that is axially inside the relieved portion 17, ie the ridges 18. The part of the bit that is axially outside the relief surface 17 may have a smaller diameter than the jacket surface of the ridges. For reasons of clearness only the jacket surface 16 and the periphery of the ridges 18 have the same diameter. The ridges 18 are provided to abut against the wall of the bore during the drilling operation in order to guide the boring head 10 in the bore. The number of ridges is at least four, preferably six. Each ridge ends axially inwards in a tip 19 which serves to break loose eventual remaining protruding rock parts out of the wall of the bore at retraction of the rock drill bit 10. A number of fluid passages 20 are provided in the bit body to conduct fluid to the drilling area and to remove the cuttings via the grooves 21.

The chisel-shaped inserts 14 are pressed into the holes in the periphery of the drill bit 10 so that the radially outermost surfaces mainly coincide with the jacket surface of the drill bit. It is understood that the word "mainly" should include a radial displacement of the radially outermost surface of each insert 14 of $-2$ to $+2$ mm relative to the jacket surface 16 of the bit body 10, preferably $+0.2$ to $+0.5$ mm. The inserts 14 are arranged so that the steel body of the bit 10 will not be excessively worn and therefore the diameter of the bore remains constant during the whole drilling operation. The front surface 13 has a central recess in which four conventional inserts 15, having no cutting edges, have been placed. The inserts 15 are provided to crack the rock material bore after the machining of the peripheral parts of the bore made by the chisel-shaped inserts 14.

Figure 4:
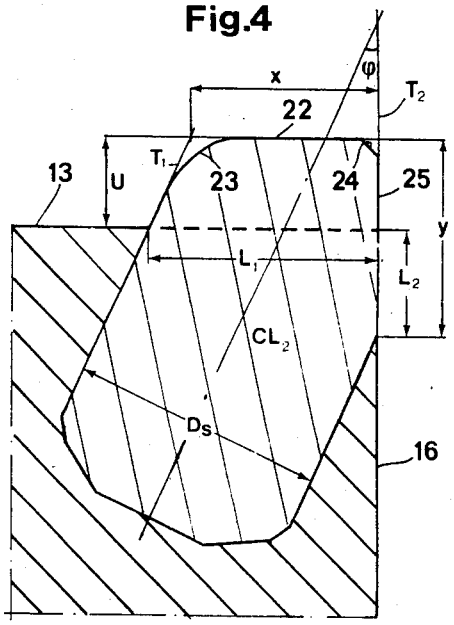
FIG. 4 is an enlarged view of a part of the rock drill bit according to the line IV—IV in FIG. 1.
Figure 2:
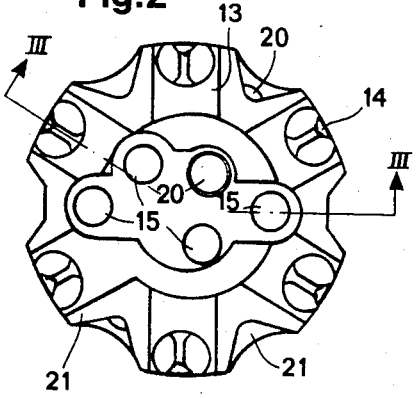
FIG. 2 is a top view of a rock drill bit according to the present invention.
Figure 5:
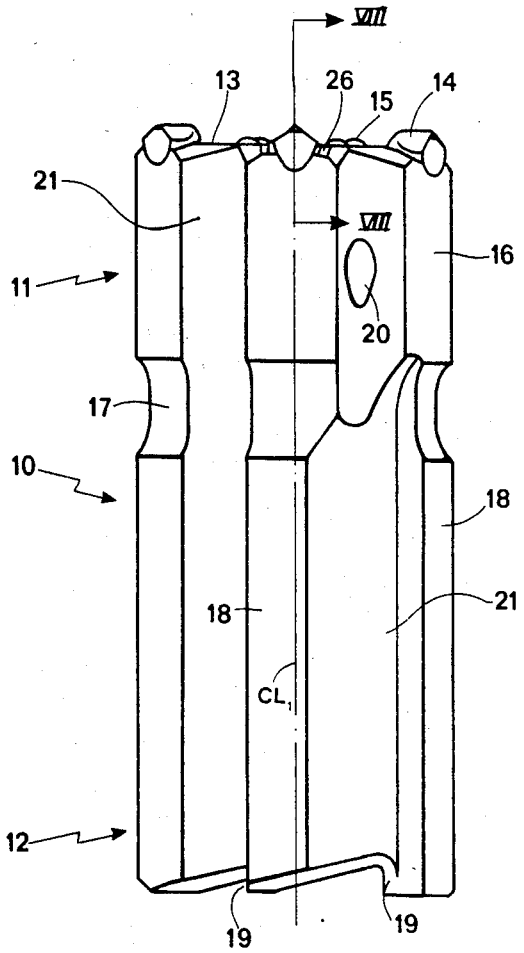
FIG. 5 shows a side view of an alternative embodiment of the rock drill bit according to the present invention.

FIG. 4 shows an enlarged section in a side view of a part of the drill bit according to the line IV—IV in FIG. 1 wherein the chisel-shaped insert 14 has been placed in a hole in the periphery of the bit, which hole partly emerges into the front surface 13 and partly into the jacket surface 16. The insert 14 has a generally cylindrical shape with a diameter $D_s$ within the interval 4 to 20 mm, preferably 7 to 18 mm. The machining part of the insert 14 is the cutting edge 22 which is surrounded by a rounded corner 23 and a chamfer 24 transferring into a guiding surface 25 which extends longitudinally between the mounting portion of the insert and the cutting edge thereof. The guiding surface 25 mainly coincides with i.e., is mainly flush with, the jacket surface 16 and has about the same radius as this surface 16. The center line $CL_2$ of the insert 14 intersects the front surface 13 and inclines an acute angle $\phi$ relative to the center line CL of the bit body 10, so that the guiding surface 25 of the insert 14 becomes arranged on both sides of the plane of the front surface 13. The cutting edge 22 protrudes a projection u from the plane of the front surface 13, (or a straight extension of the front surface 13 as shown in FIG. 4 which hereinafter will be included in the expression "the plane of the front surface", as the front surface may assume other shapes such as a conical shape), which lies within the interval 1.5 to 10 mm, preferably 2 to 6 mm. The maximum length $L_1$ of the cutting edge 22 at $u=0$ is defined as the distance between the points on the periphery of the insert that is closest to and longest away, respectively, from the center line $CL_1$ of the bit body in the plane of the front surface 13. The length x of the cutting edge 22 for an actual maximum projection of the insert is defined as the distance between the points of intersection of the normal of the center line $CL_1$ and a tangent $T_1$, being parallel with the center line $CL_2$ and coinciding with the highest point of the cutting edge 22 to the radially innermost jacket surface of the insert 14 and with a tangent $T_2$, being parallel with the center line $CL_1$, to the guiding surface 25. This means that when defining the length x of the cutting edge no consideration is taken concerning eventual rounded corner 23 or chamfer 24 and therefore the length x is given by the formula $$x=L_1-u\cdot\tan\phi$$

i.e. the length x of the cutting edge will diminish with an increasing distance u or with an increasing angle $\phi$. The length x should be not less than 4 mm and not more than 20 mm, preferably 6 to 15 mm, at angles $\phi$ between 20° and 50°, preferably 25° to 45° and at $L_1$ within the interval 4.5 to 32 mm, preferably 6.5 to 21 mm.

The axial length y of the guiding surface 25 consists of the length $L_2$ that is the distance between the axially innermost point of the guiding surface 25 and a point of intersection between the plane of the front surface 13 and the guiding surface 25, i.e. u=0, and the actual projection u so that $$y=L_2+u$$

wherein y should have a value within the interval 3.5 to 30 mm, preferably 4 to 16 mm at $L_2$-values of 2 to 20 mm, preferably 2 to 10 mm.

Thus, the length x of the cutting edge 22 depends on the length y of the guiding surface 25 so that $$x=L_1-(y-L_2)\cdot\tan\phi$$

In the embodiment of FIG. 4 the cutting edge 22 is perpendicular to the guiding surface 25 so that the cutting edge forms an angle with the center line $CL_2$ of the insert 14 that is 90° minus $\phi$. However, the cutting edge 22 may deviate from this perpendicular relationship with the guiding surface 25. All said intervals are inclusive.

The shape of the guiding surface 25 also provides for a larger number of regrindings of the cutting edge 22 of the insert 14 relative to a conventional insert without changing of the diameter of the drill bit. It is possible to grind a new cutting edge 22 a distance corresponding to about the length y.

Figure 7:
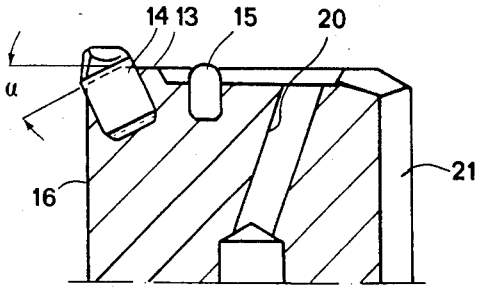
FIG. 7 shows a section of a part of the rock drill bit along the line VII—VII in FIG. 6.
Figure 8:
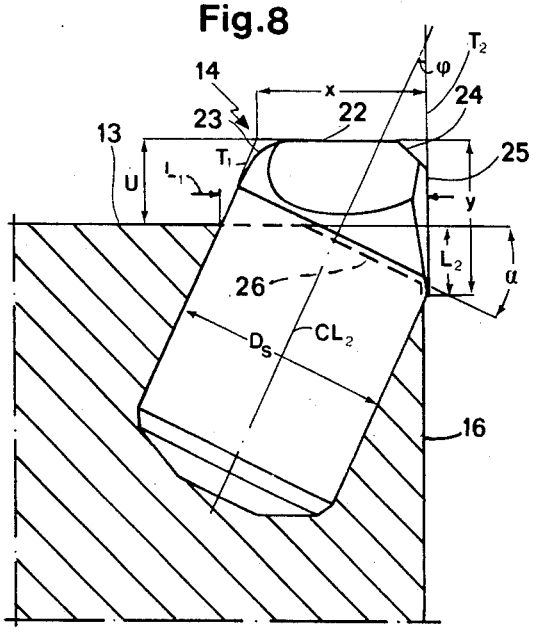
FIG. 8 is an enlarged view of a part of the rock drill bit according to the line VIII—VIII in FIG. 5.
Figure 6:
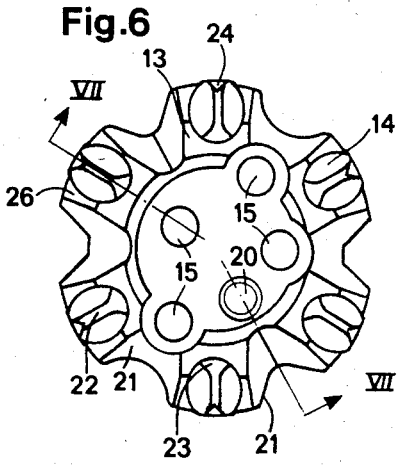
FIG. 6 is a top view of the rock drill bit shown in FIG. 5.

FIGS. 5 to 8 show an alternative preferred embodiment of the present invention in the same views as in FIGS. 1 to 4, wherein the parts of the rock drill bit have been given the same numerals as in said figures. The general differences between FIGS. 1 to 4 and 5 to 8 respectively are the provision of a peripheral bevel 26 and a guiding surface 25 that lies slightly outside the jacket surface 16 of the drill bit 10. In FIGS. 7 and 8 like in FIG. 3, however, the insert 14 is not shown in section. The bevel 26 has been ground at the outer periphery of the front surface 13 so that each bevel 26 inclines downwards and backwards an acute angle $\phi$ relative to the plane of the front surface 13. The angle $\phi$ has the same value as the angle $\phi$ shown in FIG. 4. The bevel 26 serves to facilitate the drilling of the hole in which the insert 14 is to be pressed into as it is easier to drill perpendicular to the abutment surface than in an inclined manner. In this case the center line $CL_2$ does not intersect the front surface 13 but rather the bevel 26. The guiding surface 25 still is arranged on both sides of the plane of the front surface 13. The size of the bevel 26 may vary but it must always be perpendicular to the center line $CL_2$ of the insert 14. The axial extension of the bevel 26 is either less than the length $L_2$ or equal to or more than the same. The radial extension of the bevel 26 is less than the length x. The insert 14 partly projects in the radial direction of the bit body 10 in order to drill a bore in the rock that does not wear on the jacket surface 16. The formulas given earlier in the specification are applicable also in connection with this rock drill bit.

It is an advantage at the drilling of rocks that the length of the cutting edge 22 may be short so that each insert 14 operates with a higher surface pressure at constant low feeding forces on the drill bit. It is also advantageous to have a lot of cutting edges along the periphery of the bit body to achieve an even drilling operation. In conventional rock drill bits it has not been possible to use inserts with a short cutting edge length as they demand very wear resistant hard material that, however, would not endure the high temperature of the brazing process. The brazing process also demands much heat conducting material around each insert which contradicts the possibility of having a lot of inserts along the periphery of the bit.

The present invention results in that a chisel-shaped insert may be pressed into a bore in a rock drill bit and it is secured in the bore through shrinking of the bit body or through tight fit. These securing methods make it possible to use harder and more wear resistant but heat sensitive hard materials for the inserts that hitherto not have been usable, i.e. materials such as hard metal having a Vicker's hardness of at least 1200 and preferably 1350. The use of more wear resistant hard material makes it also to a high degree possible to close-pack the chisel-shaped inserts with short cutting edges along the periphery of the rock drill bit.

We claim:

1. A rock drill bit of the impact type, comprising:

a shaft, a boring head situated at a forward end of said shaft and defining a first longitudinal axis, said boring head comprising a generally forwardly facing front end including a front surface, a jacket surface extending generally longitudinally and defining the outer periphery of said boring head, and a plurality of holes formed in said front end, said holes each defining a second longitudinal axis diverging forwardly relative to said first longitudinal axis and forming an acute angle therewith, each said second axis intersecting the planes of said front end and said jacket surface, the intersection with said plane of said jacket surface occurring forwardly of a rear end of said hole, a plurality of cutting inserts disposed in respective ones of said holes, each insert comprising a generally cylindrical mounting portion frictionally mounted in said holes, and an outer portion extending out of said hole and including a chisel-shaped cutting edge located at a distance forwardly from a forwardmost point of said front surface and oriented generally radially with reference to said first longitudinal axis, and a guiding surface extending between said mounting portion and said cutting edge, said guiding surface being mainly flush with said jacket surface and having a curvature of generally the same radius as said jacket surface, said guiding surface extending forwardly and rearwardly of said front surface.

2. A rock drill bit according to claim 1, wherein said front end of said boring head includes a bevel surrounding said front surface and extending to the peripheral edge of said front end, said insert holes intersecting said front surface, said bevel, and said jacket surface.

3. A rock drill bit according to claim 2, wherein said bevel defines a bevel angle of substantially the same size as said acute angle formed between said first and second axes.

4. A rock drill bit according to claim 1, wherein said inserts are frictionally retained in said holes by a press-fit.

5. A rock drill bit according to claim 1, wherein said inserts are frictionally retained in said holes by heat shrinking said boring head.

6. A rock drill bit according to claim 1, wherein said cutting edge is spaced forwardly from said front end by a distance $\mu$ and has a length x, and said guiding surface has a longitudinal length y parallel to said first axis, such that $x=L_1-(y-L_2)\times\tan\delta$ wherein L is the length of the cutting edge at $\mu=0$, and $L_2$ is the longitudinal length of the guiding surface at $\mu=0$.

7. A rock drill bit according to claim 6, wherein $L_1$ is from 4.5 to 32 mm, $L_2$ is from 2 to 20 mm, y is from 3.5 to 30 mm, and angle $\delta$ is from 20° to 50°, whereby x is from 4 to 20 mm.

8. A rock drill bit according to claim 7, wherein $L_1$ is from 6.5 to 21 mm, $L_2$ is from 2 to 10 mm, y is from 4 to 16 mm, and angle $\delta$ is from 25° to 45°, whereby x is from 6 to 15 mm.

9. A rock drill bit according to claim 7, wherein said inserts have a diameter from 4 to 20 mm.

10. A rock drill bit according to claim 9, wherein said inserts have a diameter from 7 to 18 mm.

11. A rock drill bit according to claim 2, wherein said cutting edge is spaced forwardly from said front end by a distance $\mu$, said bevel having a longitudinal component parallel to said first axis which is shorter than a longitudinal length of said guiding surface at $\mu=0$.

12. A rock drill bit according to claim 2, wherein said cutting edge is spaced forwardly from said front end by a distance $\mu$, said bevel having a longitudinal component parallel to said first axis which is at least equal to a longitudinal length of said guiding surface at $\mu=0$.

13. A rock drill bit according to claim 2, wherein said bevel has a radical component which is less than the length of said cutting edge.

14. A rock drill bit according to claim 1, wherein said inserts are formed of hard metal having a Vicker's hardness of at least 1200.

15. A rock drill bit according to claim 14, wherein said Vicker's hardness is 1350.

16. A rock drill bit according to claim 1, wherein said cutting edge is oriented substantially perpendicularly to said guiding surface as viewed in a plane containing said cutting edge and said second axis, said cutting edge forming with said second axis an angle defined by 90° minus said angle formed between said first and second axes.

17. A rock drill bit according to claim 1, wherein said front surface is planar and perpendicular to said first axis.

18. A rock drill bit according to claim 1, wherein said holes intersect said jacket surface.

* * * * *